US011243010B2

(12) United States Patent
Emery

(10) Patent No.: US 11,243,010 B2
(45) Date of Patent: Feb. 8, 2022

(54) WATER HEATER INSERT

(71) Applicant: ECONOMICO, LLC, Boynton Beach, FL (US)

(72) Inventor: Christopher Emery, Boynton Beach, FL (US)

(73) Assignee: ECONOMICO, LLC, Boynton Beach, FL (US)

( * ) Notice: Subject to any disclaimer, the term of this patent is extended or adjusted under 35 U.S.C. 154(b) by 599 days.

(21) Appl. No.: 16/237,225

(22) Filed: Dec. 31, 2018

(65) Prior Publication Data

US 2020/0208874 A1 Jul. 2, 2020

(51) Int. Cl.

| | |
|---|---|
| ***A47K 3/28*** | (2006.01) |
| ***F24H 1/16*** | (2022.01) |
| ***E03C 1/044*** | (2006.01) |
| ***E03C 1/04*** | (2006.01) |
| ***F24H 9/00*** | (2022.01) |
| ***B05B 1/24*** | (2006.01) |
| *B05B 1/18* | (2006.01) |

(52) U.S. Cl.

CPC ..... *F24H 1/162* (2013.01); *B05B 1/24* (2013.01); *E03C 1/044* (2013.01); *E03C 1/0404* (2013.01); *E03C 1/0408* (2013.01); *F24H 9/0021* (2013.01); *B05B 1/18* (2013.01)

(58) Field of Classification Search

CPC ..... F24H 1/101; F24H 1/103; F24H 1/162; B05B 1/24; E03C 1/044

See application file for complete search history.

(56) References Cited

U.S. PATENT DOCUMENTS

| | | | | |
|---|---|---|---|---|
| 2,044,634 A * | 6/1936 | Rieder | B05B 1/24 392/473 |
| 2,347,122 A * | 4/1944 | Peet | F24H 1/162 392/481 |
| 2,398,136 A * | 4/1946 | Drabble | B05B 1/24 392/315 |
| 2,866,884 A * | 12/1958 | Minier | F24H 1/102 392/489 |
| 4,484,062 A * | 11/1984 | Estevez | F24H 1/103 137/341 |
| 2004/0096203 A1* | 5/2004 | Tommaso | B05B 1/18 392/465 |
| 2010/0092163 A1* | 4/2010 | Yeung | F24H 1/162 392/441 |
| 2017/0251528 A1* | 8/2017 | Li | F24H 1/162 |
| 2018/0031270 A1* | 2/2018 | Kim | F24H 9/18 |

FOREIGN PATENT DOCUMENTS

| | | | |
|---|---|---|---|
| WO | WO-9807522 A1 * | 2/1998 | E03C 1/0404 |
| WO | WO-2011066636 A2 * | 6/2011 | F24H 1/103 |

* cited by examiner

*Primary Examiner* — Reinaldo Sanchez-Medina
(74) *Attorney, Agent, or Firm* — Golab Intellectual Property; Mario Sergio Golab

(57) ABSTRACT

A water heater insert device positioned within an electrical showerhead or as a standalone liquids heating device. The water heater insert optimizes heat transfer by channeling water through a channel of a spiral or zigzag form where a deployed heating element supplies thermal energy. The channel maximizes water contact while minimizing the space. A temperature limiter adds protection against scalding.

21 Claims, 3 Drawing Sheets

WATER HEATER INSERT

FOREIGN FILLING LICENSE

I request a foreign filling license.

CROSS REFERENCE TO RELATED APPLICATIONS

Not Applicable

FEDERALLY SPONSORED RESEARCH

Not Applicable

SEQUENCE LISTING OR PROGRAM

Not Applicable

REFERENCES CITED

None

BACKGROUND

Field of Application

The present invention relates to an electrical device for heating liquids in general, and water in particular, the inventive device being interspersed in a plumbing system.

The present invention in particular contemplates interspersing the inventive device into a showerhead, a sink faucet, and any plumbing outlet where heated water may be required. The present invention is a significant improvement over existing plumbing interspersed water heaters inasmuch as it delivers greater efficiency on electricity consumption for the purpose of heat transfer and temperature limit control and to a lesser extent water savings derived from a faster reaching of an optimal water temperature.

State of the Art

The prevalent method of heating liquids consists of passing a liquid through an electrical heat exchanger device where thermal energy is supplied on one side and it is absorbed by the liquid on the other side, such that the liquid's temperature increases.

There is a great variety of electrical heat exchangers in the market and others contemplated in the literature. The present invention, although not limited to heating water, is particularly applicable for use as an electrical showerhead mounted heater or a faucet mounted heater.

It has been known for some time that electric tankless water-heaters convert electricity into thermal energy by means of a heating element that comes in direct or indirect contact with water flowing through it.

In many parts of the world, electric tankless heaters are incorporated directly into shower pipes as showerheads. The water heating is achieved by providing a cavernous container wherein an electricity semi-conducting heat-producing material is disposed and comes in direct contact with water. As electricity is turned on, it flows through a heat producing element that dissipates the heat as thermal energy, which in turn gets absorbed by the water in various degrees of homogeneity and efficiency. The resulting heated water flows through an exit such as a showerhead or other hot water outlet.

To protect a water heater user from coming in direct contact with the heat producing element, often the water heater is provided as a sealed fully assembled insert unit. This insert unit is provisioned with external electrical connections and a water inlet and outlet. A sealed insert unit makes it convenient for the user to quickly replace it when the heat producing material burns out. Heating water in a cavernous container wastes lots of energy and often results in either under or overheated water, the last mode causing scalding on the person taking a shower.

Other drawbacks of the existing water heaters include the long time it takes to obtain a satisfactory steady state of water at the desired temperature and the consequent waste of large amounts of usually drinkable water that is usually unused and partially heated.

SUMMARY OF THE INVENTION

The present invention solves the energy and water waste problem by providing a heat exchanger that has an innovative built in water flow channel that maximizes heat exchange and minimizes water waste.

An additional solution is provided by the substantially reduced space occupied by the novel device which can be configured to be used anywhere hot water is required.

A further solution provided by this innovative device is that it can be provided as a sealed unit and be utilized to retrofit an existing and inefficient showerhead heater.

Lastly, a temperature limiting device may be utilized to cut off the flow of electricity to the heating element when a predetermined water temperature is reached. With no additional electricity flowing there is an effective restriction to the thermal energy supplied to the heating element. This in turn effectively limits the water temperature and thus prevents scalding of the user. Hysteresis of the heating element thermal energy should be considered when calculating the temperature cut-off for the temperature limiting device.

BRIEF DESCRIPTION OF THE DRAWINGS

The present embodiments were chosen as an example of the implementation of the innovative device. The examples are for illustration purposes only and not limiting, as any person skilled in the art will understand many other possible implementations.

DETAIL DESCRIPTION OF THE INVENTION

Figure 1:
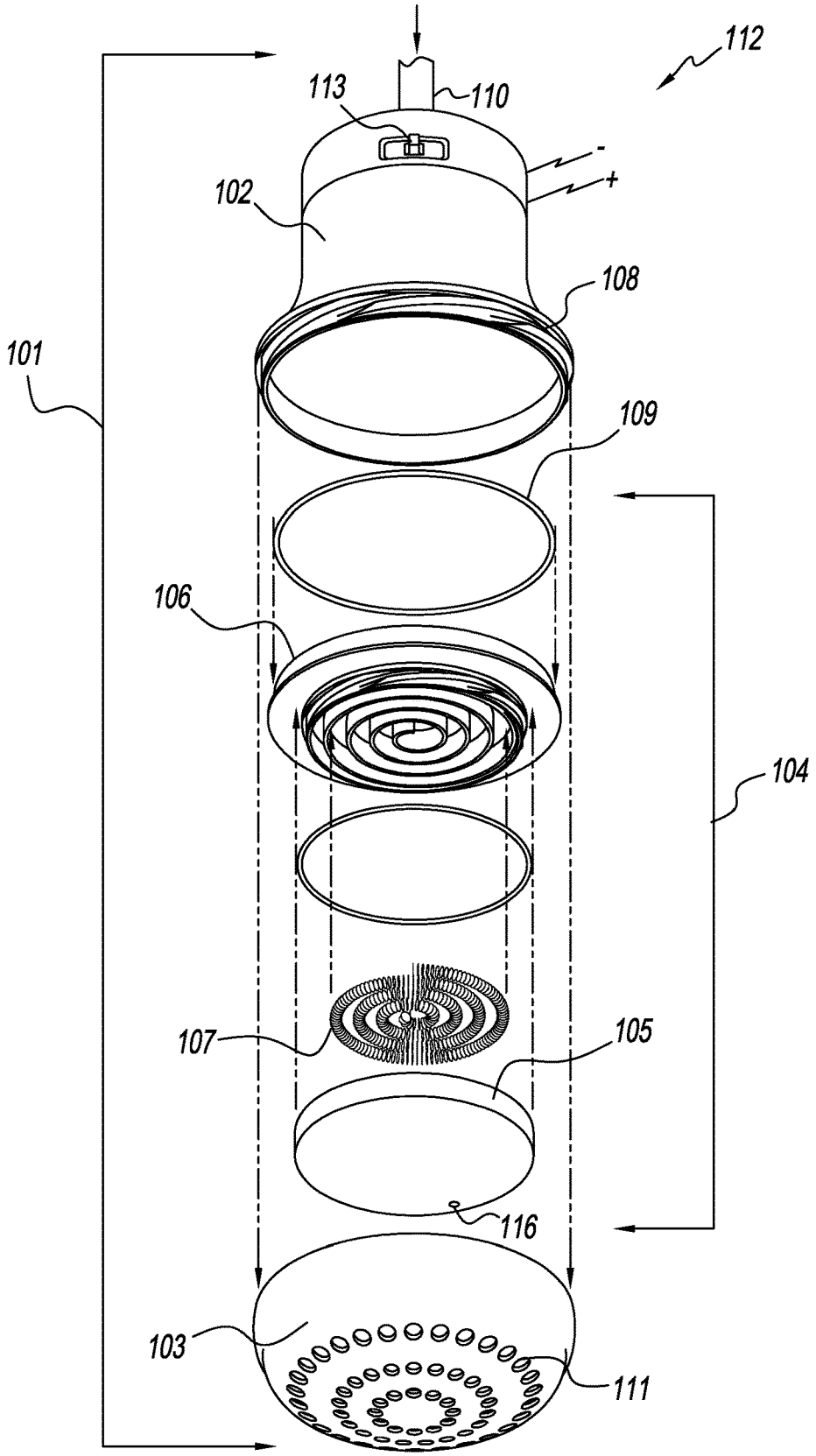
FIG. 1 shows a showerhead assembly with a water heater insert

FIG. 1 depicts a preferred view of a showerhead assembly (101) enclosing a water heater insert assembly (104). The showerhead assembly (101) basically consist of two parts: A top housing (102) and a bottom housing (103), both dimensioned to house a water heater insert assembly (104).

The top housing (102) can be attached to the bottom housing (103) by mechanical means, such as a threaded end (108), shown as an example and without limitations, by chemical bonding, or by any other means known to any person with ordinary skill in the art ("POSA"). Furthermore, a seal (109), such as an o-ring, a flat seal, a seal made of oakum, a glue seal, seal tape, and others seals know to any POSA, may be used to prevent the showerhead assembly (101) from leaking.

The showerhead assembly (101) permits entering of water from a water supply line by means of a coupling (110) located on the top housing (102). Once the water passes through the water heater insert assembly (104) and is heated to a desired temperature, the water exits the bottom housing (103) trough showerhead orifices (111) perforated therein. A power supply terminal (112) is provisioned on the top housing (102) to connect to an external power supply to supply electricity to a heating element (107). The showerhead assembly (101) may also be provisioned with a power supply interrupter (113).

The power supply interrupter (113) may optionally provide one or more discrete intermediate power settings or a continuous regulation of power settings such that one or more portions of the heating element (107) are engaged in providing heat transfer to the water passing through the water heater insert (104). The power supply interrupter (113) may be discrete; meaning each setting corresponding to a pre-determined length of the heating element (107) up to activated at full power. In the case of a continuous regulation of power supply, the amount of power supply may be regulated by a regulator (not shown), well known to any POSA, from no power supply to full power supply; but in this event the entire heating element (107) is receiving various levels of power supply selected to achieve a desired level of heat transfer.

Figure 2:
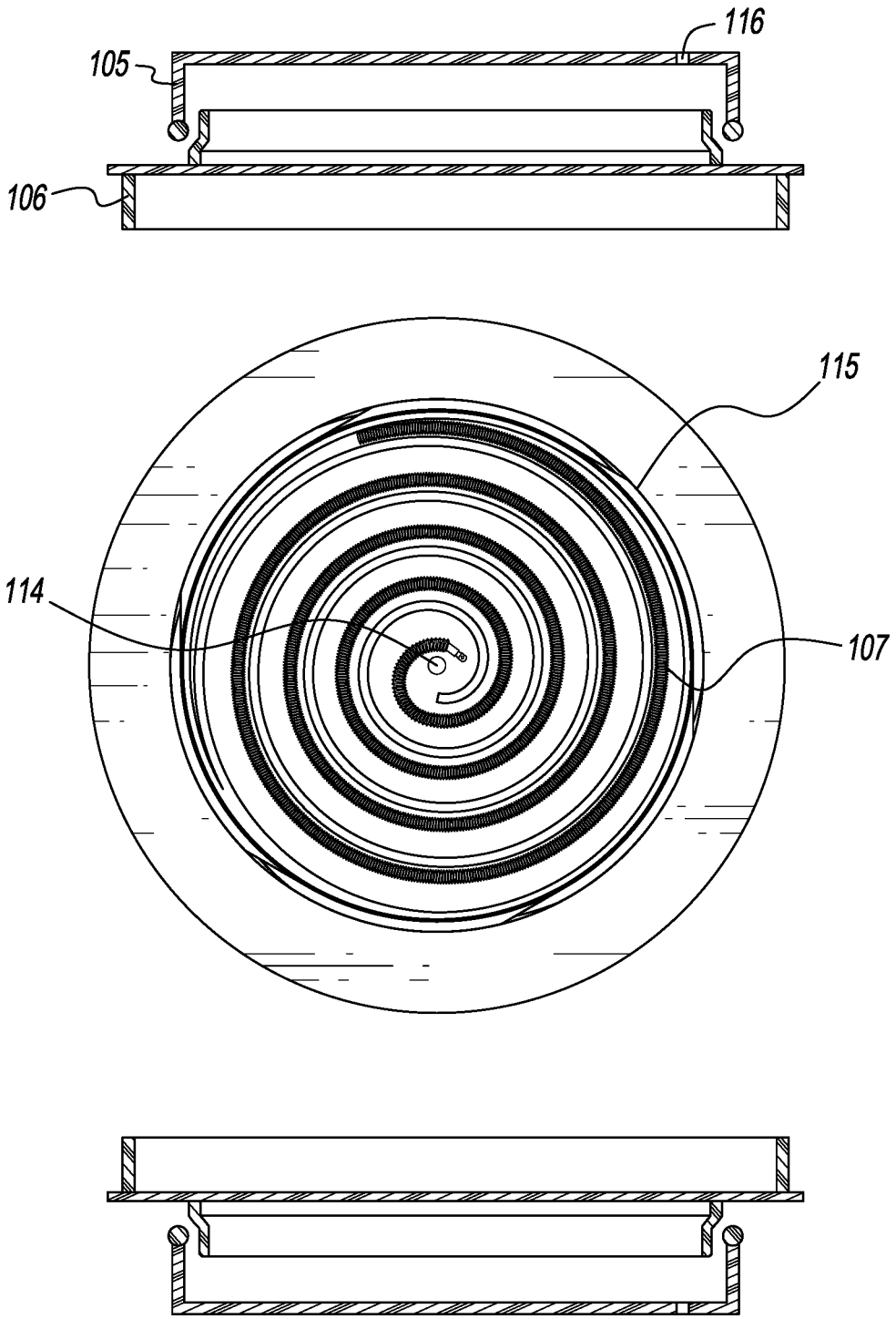
FIG. 2 shows a water heater insert assembly with a spiral channel design

FIG. 2 depicts the novel water heater insert assembly (104), which consists of three parts: A top cover (106), a bottom cover (105), and a heating element (107).

In a preferred embodiment, the top cover (106) has one or more orifices (114), disposed such that water entering the top housing (102) enters the water heater insert (104) in an area that permits direct contact with the heating element (107).

In this specific embodiment, a spiral channel (115) is formed as part of the top cover (106). Nothing prevents the spiral channel (115) to be formed as part of the bottom cover (105), or as an independent part of either the top cover (106) or the bottom cover (105).

The spiral channel (115) hosts an electrically connected heating element (107), through which passing water absorbs the thermal energy dissipated by the heating element (107) to increase the water's temperature. The water, incoming through one or more top cover orifices (114), flows through the spiral channel (115) maximizing contact surface with the heating element (107) thus maximizing heat transfer in a minimum of space.

The heating element (107) may be connected to the power supply terminal (112), to the power supply interrupter (113), or to the power supply regulator (not shown) through cables, or other electrically conducting means known to any POSA, passing through one or more orifices (not shown) on the top cover (106) or bottom cover (105).

The spiral channel (115) may be sealed (not shown) from the bottom cover (105) by any sealing means known to any POSA, such that water flows through the designated channel in the spiral channel (115) and does not mix with an adjacent channel carrying water at a different temperature.

The heated water exits the water heater insert assembly (104) at one or more orifices (116) on the bottom cover (105). Heated water accumulates on the space between the bottom cover (105) and the bottom housing (103) before exiting the bottom housing (103) through the showerhead orifices (111).

Optionally, a temperature limiter sensor (not shown), known to any POSA, connected to either the power supply terminal (112), the power supply interrupter (113), or the power supply regulator (not shown), and immersed in the water about to pass through the showerhead orifices (111), accumulated on the space in between the bottom cover (105) and the bottom housing (103), is used to disconnect the power supply once the water temperature about to exit the showerhead orifices (111) reaches a pre-determined temperature, thus preventing scalding of a person receiving the hot water.

Figure 3:
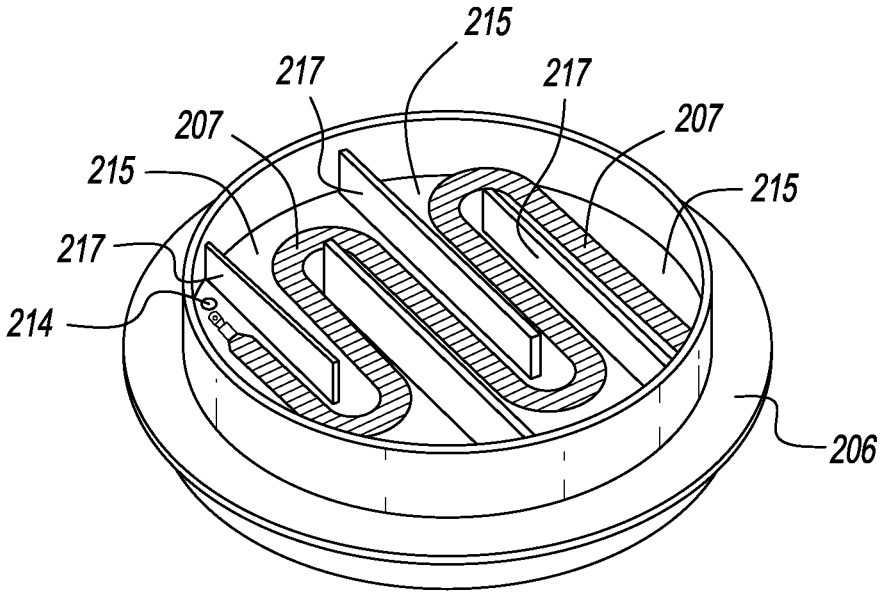
FIG. 3 shows a water heater insert assembly with a zigzag channel design
Figure 3:
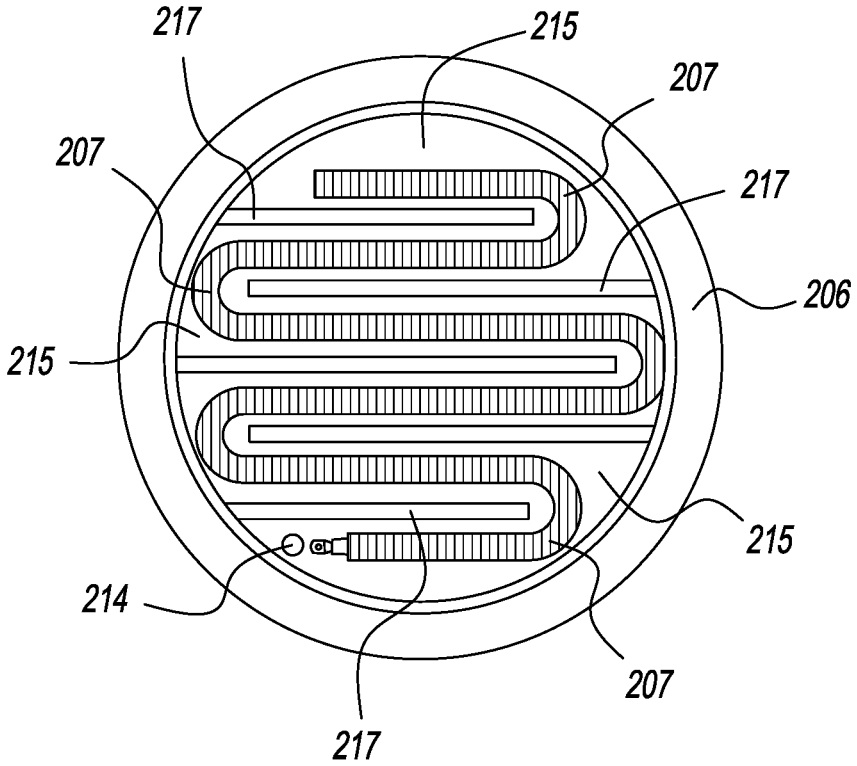

FIG. 3 depicts an alternative embodiment of the novel water heater insert assembly (104). This particular embodiment consists of three parts: A top cover (206), a bottom cover (not shown), and a flat heating element (207).

In this alternative embodiment, the top cover (206) has one or more orifices (214), disposed along a water channel (215) such that water entering the top housing (102) enters this alternative water heater insert in an area that permits contact with the flat heating element (207).

In this alternative embodiment, the water channel (215) has a zigzag form, formed by channel walls (217) and top cover walls that contour a flat heating element (207). Nothing prevents the channel walls (217) to be part of the bottom cover or be a standalone element independent of the top or bottom covers as any POSA will know.

The flat heating element (207) may be connected in the many ways known to any POSA.

The heated water exits the water heater insert assembly (104) at one or more orifices (116) on the bottom cover (105). Heated water accumulates on the space between the bottom cover (105) and the bottom housing (103) before exiting the bottom housing (103) through the showerhead orifices (111).

The novel water heater insert assembly (104) may be used as an independent water heater and as such it may be incorporated into existing showerhead assemblies or as part of any water heating system.

What is claimed is:

1. A liquids heating device, disposed in-line on a piped liquid supply, to effect an increase in the liquids' temperature as the liquids pass through the device, the liquids heating device comprising:

a top cover having a convex side and a concave side;

at least one electrical orifice the top cover, communicatively connecting the convex side and the concave side, that serve as a conduit for power supply cables;

at least one liquids' inlet communicatively connecting the top cover's convex side and the concave side;

a liquids' channel having a spiral path, disposed on the top cover's concave side, having an inlet chamber where the liquid enters through the at least one liquids' inlet and traverses the liquids' channel where heat exchange takes place, and a liquids' channel end where the liquids exit;

a heating element, disposed within the liquids' channel, having a first connection end and a second connection end, both connection ends electrically connected to a power supply;

a bottom cover having a convex side and a concave side;

at least one liquids orifice on the bottom cover, communicatively connecting the convex side and the concave side, that serves as a liquids' outlet;

at least one liquid-proof leak-proof seal disposed between the top cover and the bottom cover; and the top cover joined the bottom cover, sealed with the least one liquid-proof leak-proof seal, having the heating element connected to the power supply though electrical cables traversing the at least one electric orifice, having liquids entering the device through the at least one liquids' inlet on the top cover and flowing through the liquids' channel, absorbing heat from the heating element and exiting the at least one liquids' orifice on the bottom cover.

2. The heating element of claim 1, further comprising a temperature limiter sensor electrically connected to the power supply and disposed in direct contact with the liquids such that upon reaching a pre-determined liquids' temperature the temperature limiter sensor disconnects the power supply to the heating element.

3. The heating element of claim 1, further comprising at least one middle connection end, disposed between the first connection end and the second connection end, electrically connected to the power supply, such that only a discrete part of the heating element or all may be utilized as desired.

4. The heating element of claim 1, further comprising an electrical connection to a power supply regulator such that the flow of electricity can be controlled.

5. The power supply regulator of claim 4, whereby the power supply regulator can be adjusted to at least one discrete power supply level in between disconnected and maximum power.

6. The power supply regulator of claim 4, whereby the power supply regulator can be adjusted continuously to any level of power supply between disconnected and maximum level.

7. The at least one liquid-proof leak-proof seal of claim 1, whereby the seal is selected from a group consisting of at least one o-ring, at least one flat seal, glue, seal tape, treated oakum, and heat fusion.

8. A showerhead water heater device, disposed on a piped water supply, to effect an increase in temperature as water passes through the device, the showerhead water heater device comprising:

a showerhead housing comprising:

a top showerhead housing, having a water end and a bottom end, whereby the water end permits a connection to an external water supply;

a bottom showerhead housing, having an upper end and a showerhead orifices end, whereby the upper end can be joined to the top showerhead bottom end, and the showerhead orifices end permits exiting of water; and a power supply terminal permitting connection to an external power supply;

a water heater insert disposed inside the showerhead housing, the water heater insert comprising:

a top cover having a convex side and a concave side;

at least one electric orifice on the top cover, between the convex side and the concave side, that serves as a conduit for power supply cables;

at least one water inlet disposed on the top cover communicatively connecting the top cover's convex side and concave side;

a spiral channel, disposed on the top cover's concave side, having an inlet chamber where water enters through the at least one water inlet, a main channel where heat exchange takes place, and a channel end where water exits;

a heating element, disposed within the spiral channel, having a first connection end and a second connection end, both first and second connection ends electrically connected to the showerhead housing's power supply terminal;

a bottom cover having a convex side and a concave side;

at least one water orifice on the water heater insert's bottom cover, between the convex side and the concave side, disposed adjacent to the spiral channel's channel end, that serves as a water outlet;

at least one water-proof leak-proof seal disposed between the top cover and the bottom cover; and the water heater insert's top cover joined the bottom cover, sealed with the least one water-proof leak-proof seal, having the heating element connected to the power supply terminal through electrical connections, the electrical connection traversing the at least one electric orifice, having water entering the water heater insert through the at least one water inlet on the top cover, flowing through the spiral channel, absorbing thermal energy from the heating element and exiting the at least one water orifice on the bottom cover and then exiting the showerhead water heater device through the showerhead orifices end.

9. The heating element of claim 8, further comprising a temperature limiter sensor electrically connected to the power supply disposed in direct contact with the water such that upon reaching a pre-determined water temperature the temperature limiter sensor disconnects the power supply to the heating element.

10. The heating element of claim 8, further comprising at least one middle connection end, disposed between the first connection end and the second connection end, electrically connected to the power supply, such that only a discrete part of the heating element or all may be utilized as desired.

11. The heating element of claim 8, further comprising an electrical connection to a power supply regulator such that the flow of electricity can be controlled.

12. The power supply regulator of claim 11, whereby the power supply regulator can be adjusted to at least one discrete power supply level in between disconnected and maximum level.

13. The power supply regulator of claim 11, whereby the power supply regulator can be adjusted continuously to any level of power supply between disconnected and maximum level.

14. The at least one water-proof leak-proof seal of claim 8, whereby the seal is selected from a group consisting of at least one o-ring, at least one flat seal, glue, seal tape, treated oakum, and heat fusion.

15. A water heater insert device, disposed in-line on a piped water supply, to effect an increase in water's temperature as it passes through the device, the water heater insert device comprising:

a top cover having a convex side and a concave side;

at least one electric orifice communicatively connecting the convex side and the concave side, that serves as a conduit for power supply cables;

at least one water inlet communicatively connecting the convex side and the concave side;

a zigzag water channel, disposed on the top cover's concave side, the zigzag water channel formed by intercalating at least two walls, each wall constructively connected on one end to the top cover's concave side and on the other end leaving a free space between the wall and the concave side, the zigzag water channel guiding the water entering through the at least one water inlet to follow a zigzag pattern before exiting the zigzag water channel at the zigzag water channel end;

a heating element, disposed within the zigzag water channel, having a first connection end and a second connection end, both connection ends electrically connected to a power supply;

a bottom cover having a convex side and a concave side;

at least one water orifice on the bottom cover, communicatively connecting the convex side and the concave side, located adjacent to the zigzag water channel end, that serves as a water outlet;

at least one water-proof leak-proof seal disposed between the top cover and the bottom cover; and the top cover joined the bottom cover, sealed with the least one water-proof leak-proof seal, having the heating element connected to a power supply though electrical cables traversing the at least one electric orifice, having water entering the device through the at least one water inlet on the top cover, flowing through the zigzag channel, absorbing thermal energy from the heating element, and exiting the at least one water orifice on the bottom cover.

16. The heating element of claim 15, further comprising a temperature limiter sensor electrically connected to the power supply disposed in direct contact with the water such that upon reaching a pre-determined water temperature the temperature limiter sensor disconnects the power supply to the heating element.

17. The heating element of claim 15, further comprising at least one middle connection end, disposed between the first connection end and the second connection end, electrically connected to the power supply, such that only a discrete part of the heating element or all may be utilized as desired.

18. The heating element of claim 15, further comprising an electrical connection to a power supply regulator such that the flow of electricity can be controlled.

19. The power supply regulator of claim 18, whereby the power supply regulator can be adjusted to at least one discrete power supply level in between disconnected and maximum level.

20. The power supply regulator of claim 19, whereby the power supply regulator can be adjusted continuously to any level of power supply between disconnected and maximum level.

21. The at least one water-proof leak-proof seal of claim 15, whereby the seal is selected from a group consisting of at least one o-ring, at least one flat seal, glue, seal tape, treated oakum, and heat fusion.

* * * * *